United States Patent [19]

Engdahl et al.

[11] Patent Number: 4,927,334

[45] Date of Patent: May 22, 1990

[54] LIQUID PUMP DRIVEN BY ELEMENTS OF A GIANT MAGNETOSTRICTIVE MATERIAL

[75] Inventors: Göran Engdahl, Täby; Gunnar Molund, Västeras, both of Sweden

[73] Assignee: ABB Atom AB, Västeras, Sweden

[21] Appl. No.: 282,271

[22] Filed: Dec. 9, 1988

[30] Foreign Application Priority Data

Dec. 10, 1987 [SE] Sweden ..... 8704931

[51] Int. Cl.[5] ..... F04B 17/00

[52] U.S. Cl. ..... 417/322; 310/26; 417/418

[58] Field of Search ..... 417/322, 418; 310/26

[56] References Cited

U.S. PATENT DOCUMENTS

| | | | |
|---|---|---|---|
| 2,578,902 | 12/1951 | Smith | 417/418 |
| 2,833,220 | 5/1958 | Robinson et al. | 417/418 |
| 3,134,938 | 5/1964 | Morgan | 310/30 |
| 4,308,474 | 12/1981 | Savage et al. | 310/26 |
| 4,795,318 | 1/1989 | Cusack | 417/322 |
| 4,802,660 | 2/1989 | Engdahl | 310/26 |

*Primary Examiner*—Leonard E. Smith
*Assistant Examiner*—David W. Scheuermann
*Attorney, Agent, or Firm*—Watson, Cole, Grindle & Watson

[57] ABSTRACT

In subsea production of oil and gas, a pressurized fluid is needed for operation of valves for the production system. To be able to supply a hydraulic actuator with pressure medium for valve operation without arranging any pressurization from a platform-based pump, a liquid pump has been produced which is driven by rods of a giant magnetostriction material and which may be connected to operating devices and valves at the bottom of the sea. The liquid pump has a high efficiency and has few movable parts. By utilizing the giant magnetostrictive in two alternately operating rods (11) which are arranged in pairs and are surrounded by coils (15) supplied with current, the first rod imparting a movement when magnetic energy is transformed into mechanical energy in the form of a deformation and the second rod dynamically prestressing the first rod together with a load, a piston (12) in a cylinder space (17) of a pump housing (16) may be caused to oscillate for transporting liquid. The giant magnetostrictive material may be an alloy containing the rare earth metals terbium (Tb) and dysprosium (Dy) and iron (Fe), for example Terfenol-D with the stoichiometric composition ($Tb_xDy_{1-x}Fe_{1.9-1.98}$).

5 Claims, 9 Drawing Sheets

LIQUID PUMP DRIVEN BY ELEMENTS OF A GIANT MAGNETOSTRICTIVE MATERIAL

TECHNICAL FIELD

The present invention relates to a pump for fluids driven by rods of a giant magnetostrictive material. As an example of a giant magnetostrictive material suitable for driving such a pump may be mentioned Terfenol-D, which is an alloy containing iron and the rare earth metals terbium and dysprosium with the stoichiometric composition $Tb_xDy_{1-x}Fe_{1.9-1.98}$.

BACKGROUND ART

It is previously known that the rare earth metals samarium (Sm), terbium (Tb), dysprosium (Dy), holmium (Ho), erbium (Er), etc., have a very high magnetostriction at very low temperatures. By alloying the rare earth metals with iron (Fe), a very high magnetostriction can be obtained also at room temperature and at temperatures of up to two to three hundred degrees Celsius. With a rod of an alloy of the type mentioned above, magnetic energy can be transformed into mechanical energy, the mechanical energy substantially manifesting itself in the form of a deformation of the rod. With alloys with iron and the rare earth metals at room temperatures, it is possible to obtain a magnetostriction of 1500–2000 μm/m, which is a linear expansion more than 30 times greater than for ordinary magnetostrictive alloys. Since a rod of the above-mentioned alloy, for example terfenol (Terfenol-D, $Tb_xDy_{1-x-c}Fe_{1.9-1.98}$) has a considerably lower tensile strength than compressive strength, the rod has to work under a compressive mechanical prestress. The necessary mechanical prestress to prevent the occurrence of a tensile stress in a rod of terfenol, at transient magnetization and a large mechanical load, is considerably greater than the prestress which is justified by merely taking into account the choice of an optimum working point.

DISCLOSURE OF THE INVENTION

To be able to supply a hydraulic actuator with pressure medium in a subsea production system for oil and gas without any pressurization from a platform-based pump, a liquid pump has been developed which is driven by rods of a giant magnetostrictive material, for example Terfenol-D, which is an alloy containing iron and the rare earth metals terbium and dysprosium ($Tb_xDy_{1-x}Fe_{1.9-1.98}$). This liquid pump has few movable parts and a high efficiency and can be positioned in immediate proximity to the actuators which it is intended to serve. By utilizing the giant magnetostriction in two alternately operating rods 11 arranged pairs, a piston 12 in a cylinder may be caused to oscillate for transport of a liquid. This can be achieved by causing a first rod (11) to impart a movement to the piston (12) in one direction when magnetic energy is transformed into mechanical energy in the form of a deformation of the first rod, while at the same time a second rod is then caused to dynamically prestress the first rod against the piston, and by causing the second rod to impart a movement to the piston in the opposite direction when magnetic energy is transformed into mechanical energy in the form of a deformation of this second rod, while at the same time the first rod is then caused to dynamically prestress the second rod against the piston. The rods of the giant magnetostrictive material are surrounded by coils and arranged in pairs and adapted to alternately influence a piston in the cylinder space 17 of a pump housing 16. Incoming and outgoing liquid lines are arranged in the end walls of the pump housing. With the aid of valve functions, for example nonreturn valves and T-couplings, a continuous pumping action of the pump is obtained.

DESCRIPTION OF AN EMBODIMENT

The liquid pump 1 according to the invention is intended to be used in a subsea production system for oil and gas. A subsea system has a number of valves 2 for control of liquid and gas flow, the valves being normally remotely controlled and operated by hydraulic actuators. An actuator converts a hydraulic pressure into a desirable working moment.

Normally, the actuators attain the necessary working pressure by pumps on a platform pressurizing a hydraulic driving fluid, which transfers the pressure to the actuators via a hydraulic line. A terfenol rod-driven liquid pump 1, on the other hand, can be designed to be installed in a subsea system at the bottom of the sea. In this way there will be no need for any supply line for hydraulic driving fluids between the platform and the subsea system, i.e. the pump pressurizes the hydraulic driving fluid directly in a hydraulic system down at the sea bottom.

A simplex electro/hydraulic subsea system is a good solution to a subsea system for production of oil and gas. Since the system constitutes a combined electric and hydraulic system, the system is equipped with supply lines for electric power supply, telecommunication (signal control) and hydraulic driving fluid between the platform and the subsea system. If terfenol rod-driven underwater pumps are mounted in a simplex subsea system, the already existing supply lines for power supply and telecommunication can be utilized for driving and controlling the underwater pumps.

Simplex subsea systems have usually been designed with a socalled fail safe safety system which enters into operation in the event of loss of the electric power supply and in the event of loss of the pressure of the hydraulic system or in case of unbalance of this pressure. Adaptation of the underwater pumps to this hydraulic system does not influence the function in the safety system.

The driving fluid in the hydraulic systems usually consists of hydraulic oils or a water-glycose mixture. Well-known facts are that a systems with driving fluid based on mineral oil have working lives approximately 10 times longer than the same equipment using water-based driving fluids. A great advantage for a pump concept with a water-based driving fluid is the insignificant compression of the fluid, which means small compression losses in a corresponding pump chamber. For maximum reliability and minimum disturbance, driving fluids based on mineral oils are to be preferred. A mineral oil with a low viscosity is therefore considered to be most suitable for both the pump concept and the hydraulic subsea system.

A total damage to hydraulic systems is usually caused by particle contaminations of the order of magnitude of greater than 45 micrometers. To protect the system against such damage, the hydraulic system has to be provided with filters for the hydraulic fluid.

Figure 1:
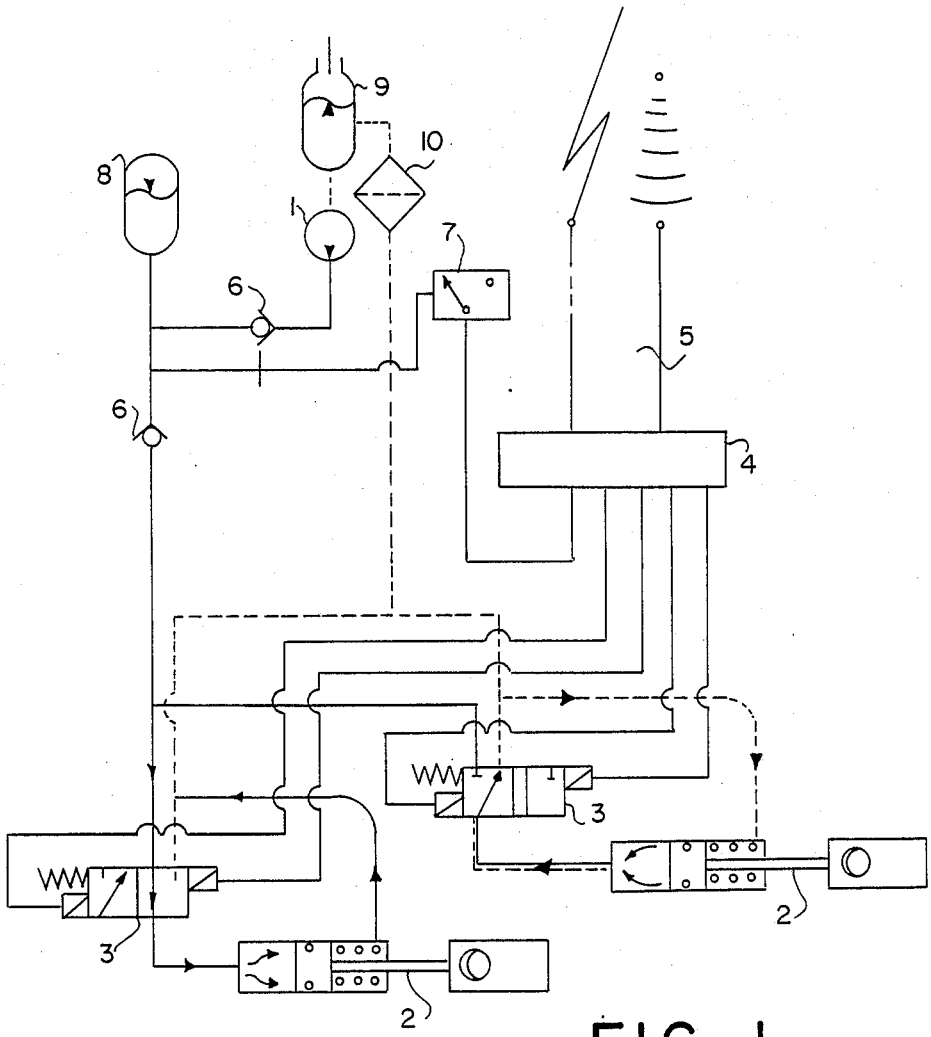
FIG. 1 shows a subsea system for actuators with a terfenol rod-driven pump.
Figure 2A:
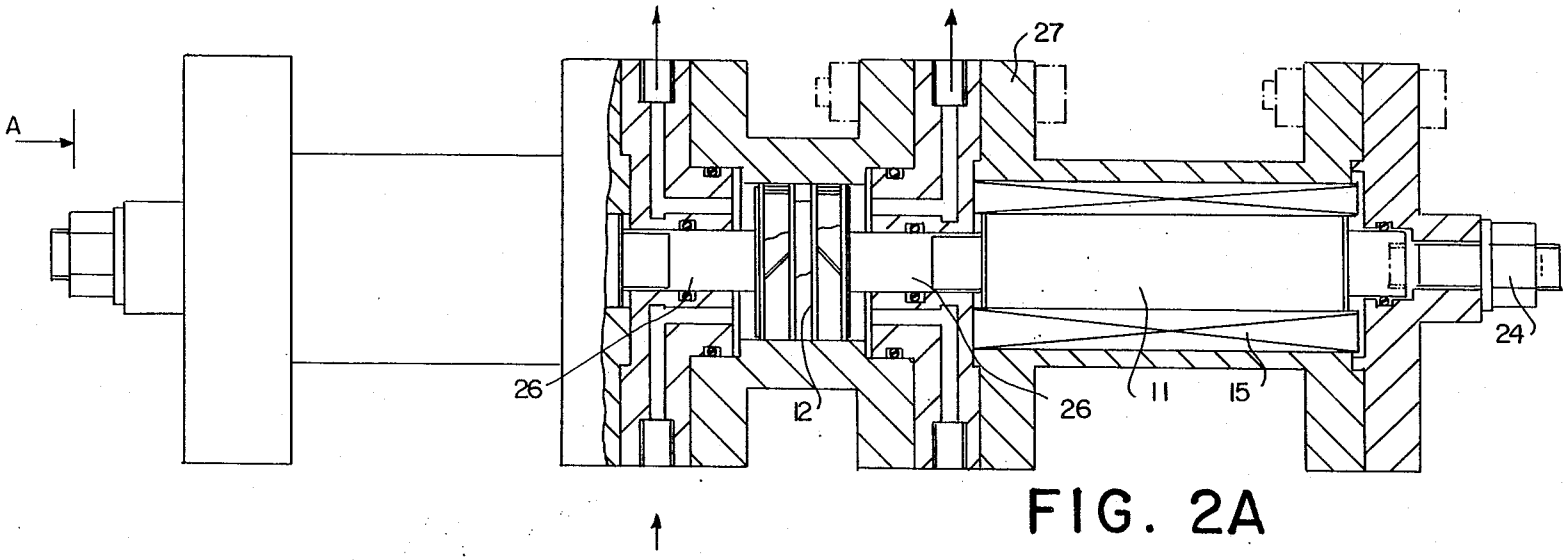
FIGS. 2A and 2B shows a fundamental solution for a terfenol rod-driven pump.
Figure 2B:
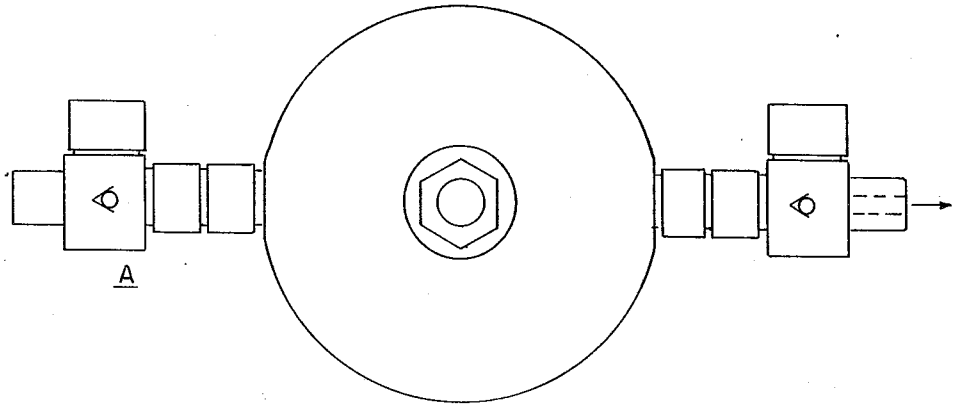
Figure 3A:
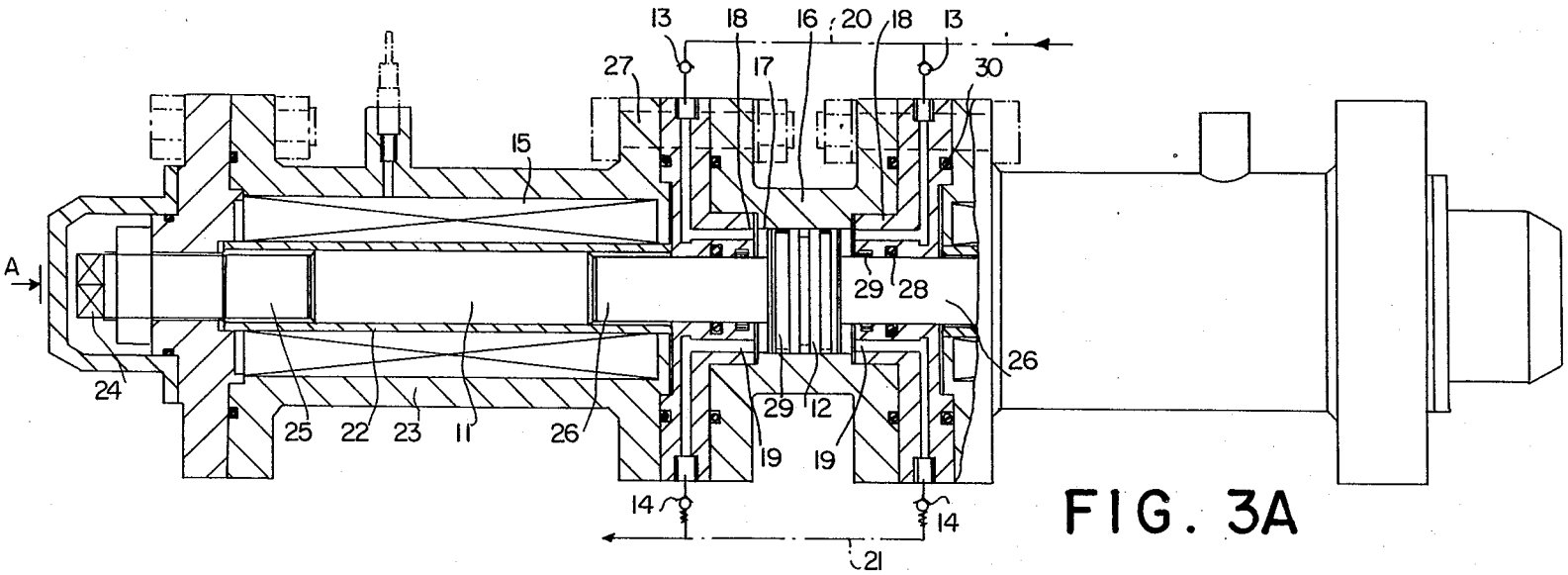
FIGS. 3A and 3B shows an alternative form of a terfenol rod-driven pump according to FIG. 2.
Figure 3B:
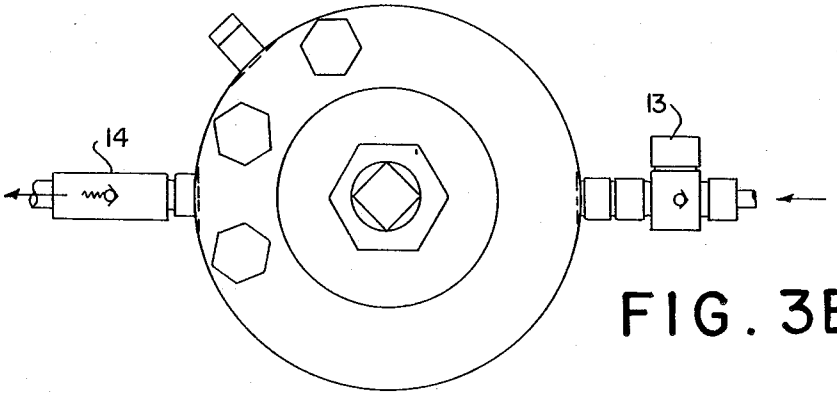

In simplified terms, a subsea hydraulic system with terfenol rod-driven liquid pumps comprises the following components (see FIG. 1):

- A production valve 2 with an actuator
- A current-controlled operating valve (of type 2-position, 3-way solenoid valve) 3
- An electronic unit 4: for control of the power supply to components
- Supply lines 5 for power and communication to the electronic unit
- Nonreturn valve 6 to prevent return flow
- A pressure governor 7 for starting and closing the pump
- An accumulator 8 for pressurizing the system
- A container 9 for return of hydraulic fluid
- An oil filter 10 for filtering the returned hydraulic fluid
- An underwater pump 1 with terfenol rods The basic principle of a pump 1 according to FIGS. 2–5 is that a two-chamber double-acting pump 1 is driven by giant magnetostriction using two alternately working rods 11 of, for example, Terfenol-D, which are arranged in pairs. In addition to the rods 11 of terfenol and a movable piston 12 or a diaphragm, the pump 1 will have no further movable parts, which means that a simple, reliable and wear-resistant construction can be obtained. The pump 1 will not comprise parts having complicated transmission movements. The valves 13, 14 for the pump 1 which control the flow must, however, comprise movable parts.

The great power resources of the terfenol elements and its high compressive strength permit the terfenol elements to work with high loads, which means that high pressures can be generated in the hydraulic liquid. Rods of terfenol expand or contract depending on the amplitude of the magnetizing currents. To obtain good efficiency, a saturation magnetostriction of at least 50% should be achieved during the magnetizing process. The rods are magnetized by surrounding coils 15 with a magnetizing field. The terfenol rods 11 operate against each other so that a compressive mechanical stress always prevails therein, in spite of the fact that these rods are not prestressed by any spring elements.

A pump concept according to the invention comprises a pump housing 16 in the form of a cylinder space 17, which is provided with openings near its end surfaces for the supply 18 and discharge 19 of liquid during pumping, and a two-sided double-acting piston acting in the cylinder space 17. Without changing the pump function, the piston can be replaced with a diaphragm.

The double-acting pump function is accomplished by the coherently operating rods imparting a reciprocating movement to the piston. When the first rod during the magnetization expands, the second rod contracts, whereby the piston is moved and one of the chambers in the cylinder space is contracted while at the same time the other chamber in the cylinder space is expanded. This means that the duble-acting piston simultaneously compresses and presses out hydraulic fluid in one chamber and decompresses and sucks in fluid in the other chamber. Thus, the rods bring about an oscillating and reciprocating piston movement, which alternately compresses and decompresses the chambers.

The piston movement described above is controlled by the current supply to the two coils 15. The basic principle of the mode of operation of the rods is that the first rod is first magnetized and extended while at the same time the second rod is demagnetized and contracted. Thereafter, the first rod contracts while at the same time the second rod expands. This is repeated so that a reciprocating movement is imparted to the piston. By the current supply to the coil, the coil produces a magnetic field. The coil can be demagnetized by the applied voltage changing polarity, which causes current to be driven out of the coil until this becomes currentless. At the same time as one of the coils is magnetized, the other coil is demagnetized.

The current which is tapped from the coil during the demagnetizing process is transferred to the other coil which, during its magnetizing phase, makes use of the current tapped from the first coil. The method described permits a very flexible embodiment of the current supply to the coils.

Since the pump operates with a short stroke, the pump area must be adapted thereto. This entails a relatively large diameter, while at the same time the openings in the pump housing have to be made relatively small in order to achieve a good pressure build-up without pulsation in the system.

Nonreturn valves 13, 14 and T-couplings 20, 21 effect a continuous transportation of the hydraulic fluid. Each of the two chambers has a suction valve 13 on its suction sides which opens when the pressure on the suction side is higher than the pressure in the chamber during the decompression phase. On its pressure side each chamber also has a pressure valve 14, which opens when the pressure in the chamber exceeds the pressure in front of the valve during the compression phase.

To obtain a pumping action, both the suction valve 13 and the pressure valve 14 shall be closed during the compression phase, and the pressure valve 14 shall be opened when an accumulator pressure has been attained in the chamber. During the decompression phase the pressure valve 14 is to be closed whereas the suction valve 13 is opened when the pressure has dropped down to a reservoir pressure, for example the prevailing ocean pressure. The pump concept can be easily adapted to be equipped with current-controlled magnet valves (solenoid valves) or similar nonreturn valves.

The pump concept is based on the terfenol rods being able to work against high loads and thus generate high hydraulic pressures. It is also based on the relatively small piston movements, which are of high frequency in connection with hydraulics, providing the desired flows. This requires valves which have a short response time (a rapid opening and closing function) and which operate well at high pressures.

The high pressure places high demands on the seal between the cone and the seats in the valves. For that reason, only valves adapted to high pressures, so-called high-pressure valves, are possible to use with terfenol rod-driven liquid pumps.

Large restriction holes require a greater force for opening a valve and therefore small restriction holes give a better response time. Small opening/closing clearances for a cone also entails a shorter response time. The closing time of the non-return valves can be shortened by using a spring-loaded cone, which also provides a marginally higher opening pressure. Among the fastest current-controlled valves is a type of two-way, direct-acting magnet valves (solenoid valves). The moderate demands of the pump concept on flows allows small restriction holes.

To obtain a rapid opening and closing of current-controlled valves, well-defined current pulses of a short duration are required, which results in rapid magnetizing and demagnetizing processes of the solenoid coils. The opening and closing of the nonreturn valves are controlled by the pressure in the chambers.

Since the high pump frequency entails an enormous number of openings and closings of the valves, this requires extra resistance to wear. Each cone and seat should therefore be manufactured of a material which is both relatively tough and wear-resistant.

Terfenol can also be used in valves, which enables a very rapid opening and closing of the valves. In addition, the settling of the terfenol against the seat can be controlled so as to become very soft, which results in the valve becoming wear-resistant. Since only little terfenol material is required in the valves, the cost of the material will be low.

A pump concept with a two-chamber, double-acting pump having terfenol rods arranged in pairs as driving source and a movable piston is less complicated in its construction compared with a movable stiff diaphragm of steel. The small size of the diaphragm and the clamping of the diaphragm are two problematic factors in the construction of a diaphragm pump. Low friction seals effect good sealing between the piston and the pump housing, and therefore a pump with a movable piston has been considered most advantageous.

The terfenol rods 11 may be enclosed within sliding sleeves 22 of, for example, brass, which serve as a guide for the terfenol rods and as a framework for the windings of the coil. To prevent inductive coupling between the coil and the pump housing, which results in energy losses, i.e. prevents the generation of eddy currents in the pump housing, the housing 23 with the coil 15 should be shielded by the use of, for example, transformer sheet. To prevent losses by the coil magnetizing the surrounding material, all construction material should preferably consist of non-magnetic materials. In addition, it is favourable to use materials which are poor electric conductors, which reduces the possibilities of energy losses by generating eddy currents.

The position of the terfenol rods 11 in the drive unit is adjusted with the aid of two adjusting screws 24. The adjusting screw can be formed so as to make contact directly with the terfenol rods 11, or the adjusting screw may make contact with a movable cylindrical spacer 23 which transmits the stress to the terfenol rod, i.e. an intermediate movable part making contact with both the screw and the rod.

The pump unit may consist of a two-chamber pump housing 16 and of a double-acting piston 12 with two piston rods 26. The pump housing 16 is suitably manufactured of corrosion-resistant stainless non-magnetic steel. Austenitic stainless steels, which are resistant to corrosion in an ocean water environment, usually contain molybdenum. Although terfenol is a material with extremely large movements due to magnetostriction, the piston movement is relatively small, of the order of magnitude of 0.1 mm. It is therefore of great importance to use stiff materials which minimize elastic losses which reduce the real stroke of the piston.

By using a sufficiently thick material in the pump housing 16 and bolted joints 27 of ample size with large screws, small elongations are obtained with construction material of stainless steel. Prestressing of the strong, thick screws reduces the elongations to very small magnitudes. During the compressing phase, the piston 12 and the piston rods 26 are compressed. This compression results in larger losses compared with elongation in the pump housing 16 and the bolted joint 27. For that reason, the piston 12 and the piston rods 26 should be manufactured of a more rigid material than stainless steel. Ceramics which are non-magnetic and poor electric conductors and considerably more rigid than stainless steel are considered a suitable material for the piston and the piston rods. Boron carbide, which is one of the more rigid ceramics, is expected to constitute a suitable material (E-modulus about 450 GPa). The movable part which transmits mechanical stress between the adjusting screw 24 and the terfenol rod 11 is suitably also made of ceramics.

The elastic deformation of the components reduces the piston stroke considerably less than the compression of the hydraulic fluid. Hydraulic oils are expected to be compressed up to about 2%. If water-based hydraulic fluids are used, the compression of the hydraulic fluid will be considerably lower. To reduce the effect of the compression of the hydraulic fluid, the pump chambers 4 should be small and formed as thin circular discs having widths of the order of magnitude of 1 mm or less.

The piston and the piston rods are sealed with low friction seals 28 of high pressure quality. The friction of the piston and the piston rods is reduced by the use of sliding rings 29. The other seals consist of O-rings 30.

Figure 6:
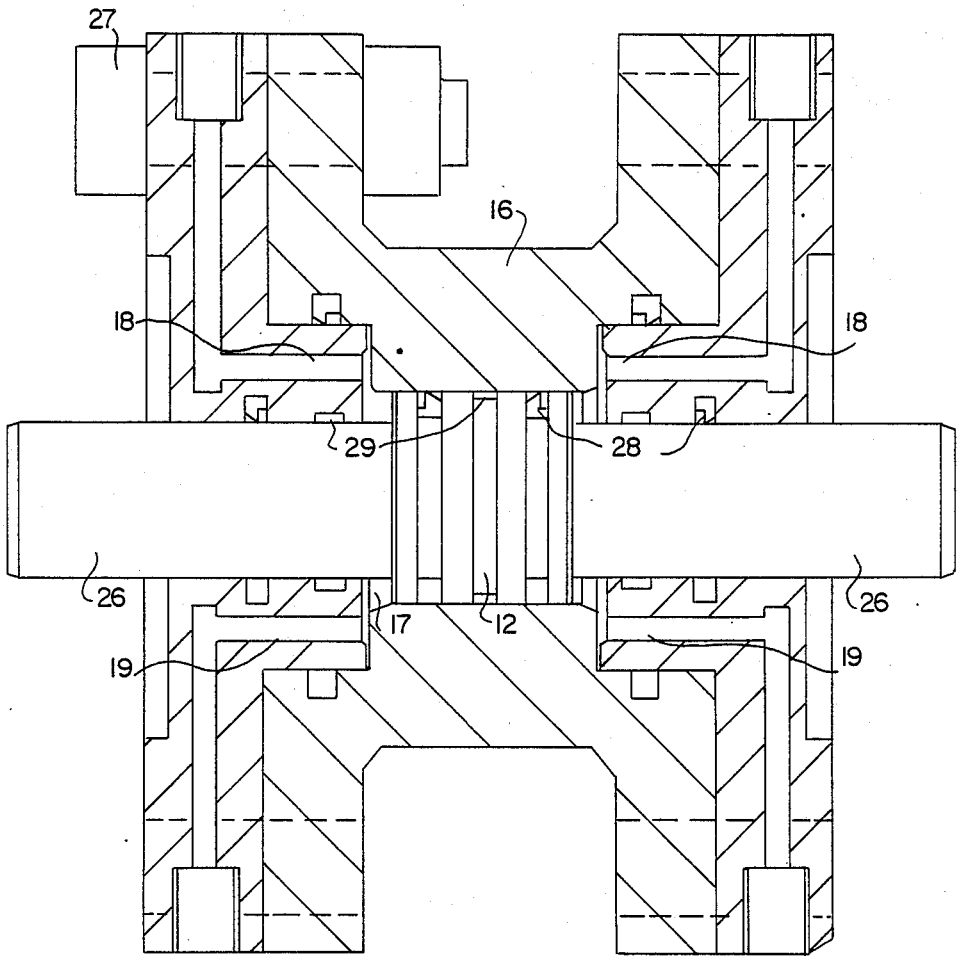
FIG. 6 shows only the pump unit in the pump.

FIG. 6 shows in more detail how the piston 12 with the piston rods 26 may be provided with low friction seals 28 and sliding rings 29. It also shows in more detail how the cylinder space 17 is formed at its ends and how the supply and discharge channels 18, 19 are oriented in relation to the cylinder space 17.

Figure 4A:
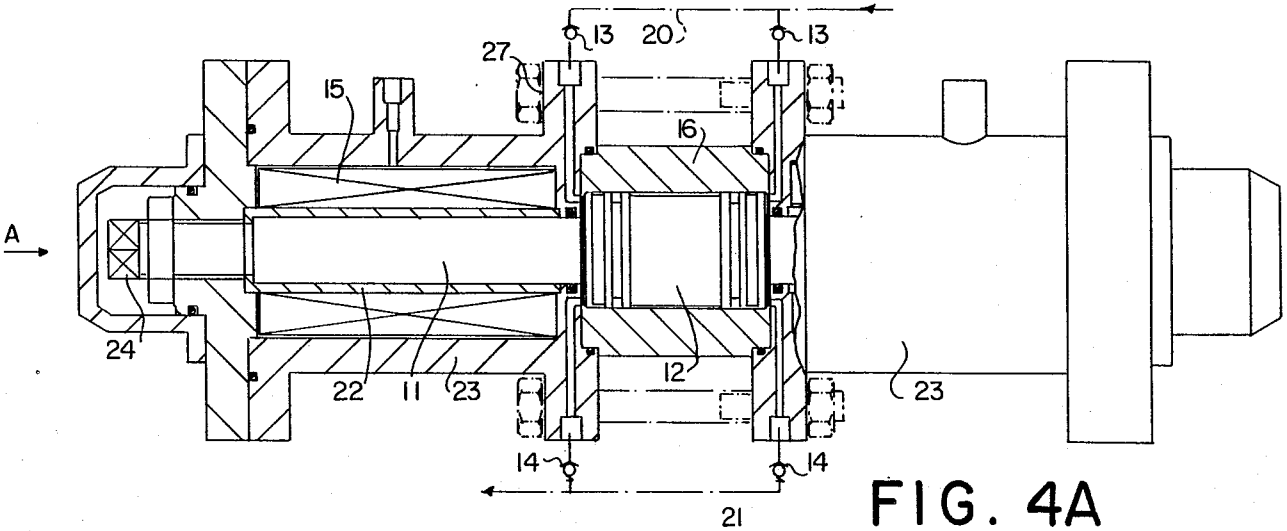
FIGS. 4A and 4B shows a terfenol rod-driven pump without piston rods.
Figure 4B:
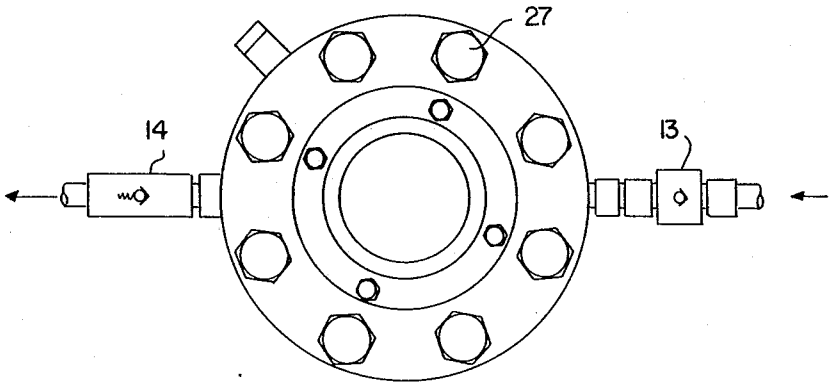
Figure 5A:
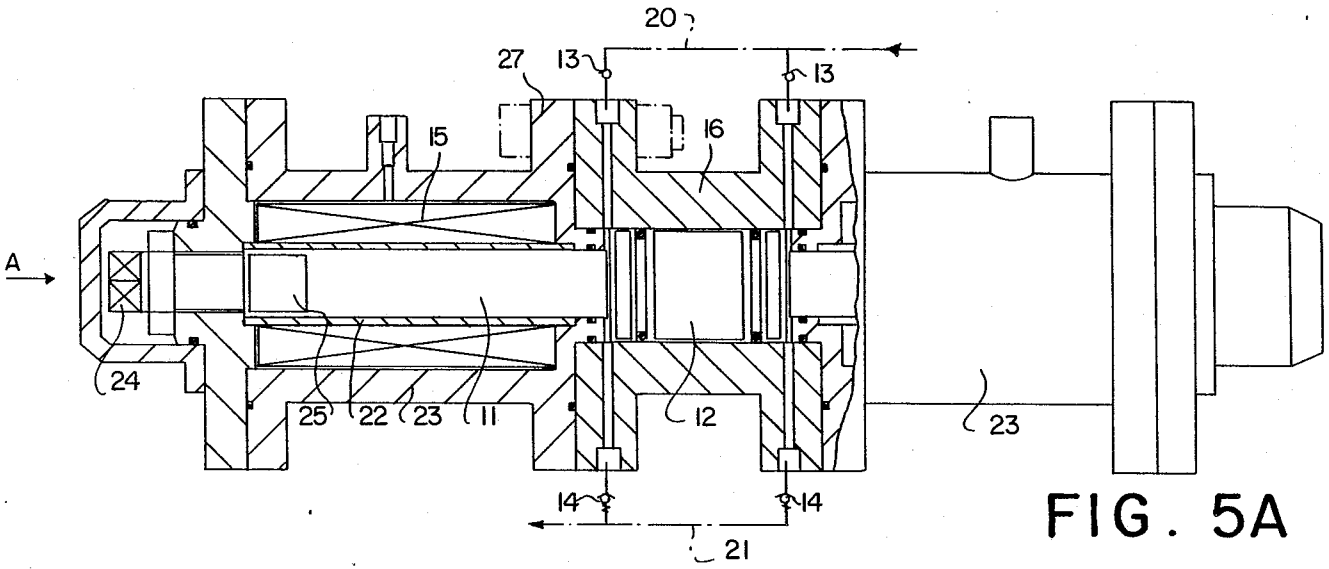
FIGS. 5A and 5B shows an alternative form of a terfenol rod-driven pump according to FIG. 4, with a movable spacer.
Figure 5B:
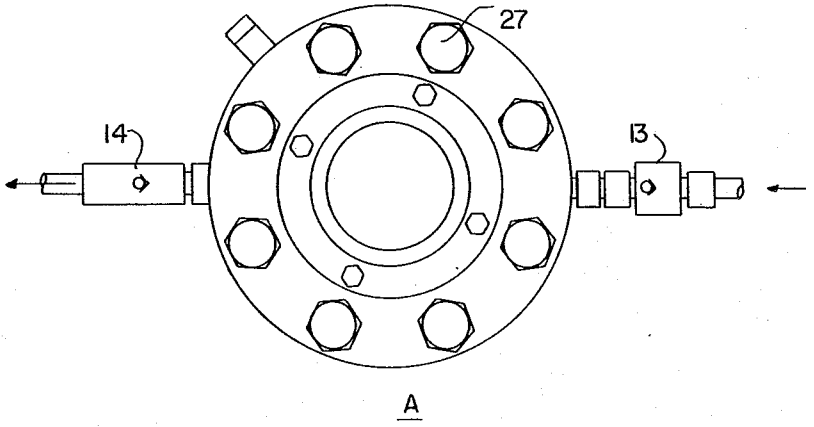

Alternatively, as shown in FIGS. 4 and 5, the piston 12 can be clamped directly in the pump unit between the terfenol rods with or without a spacer 25. The piston has no piston rods, so the coils cannot completely surround the rods. Coils which are not sufficiently long to surround the rods entail a less efficient magnetization of the outer ends of the rods, which means that these parts do not expand as efficiently as the rest of the rod. Although that part of the rod which is positioned in front of the coil does not expand as efficiently as the other parts of the rod, also this part expands to a certain extent during the magnetization process.

Figure 7:
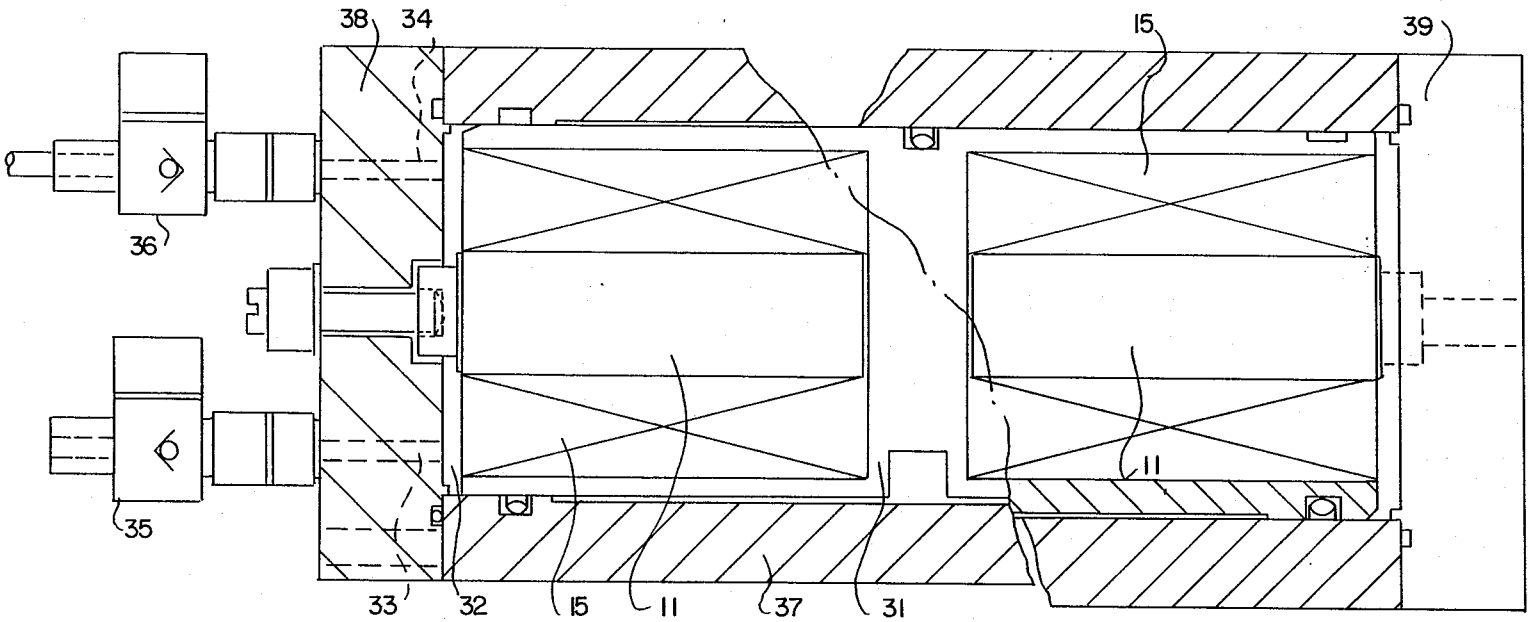
FIG. 7 shows a fundamental solution for a terfenol rod-driven pump.
Figure 8A:
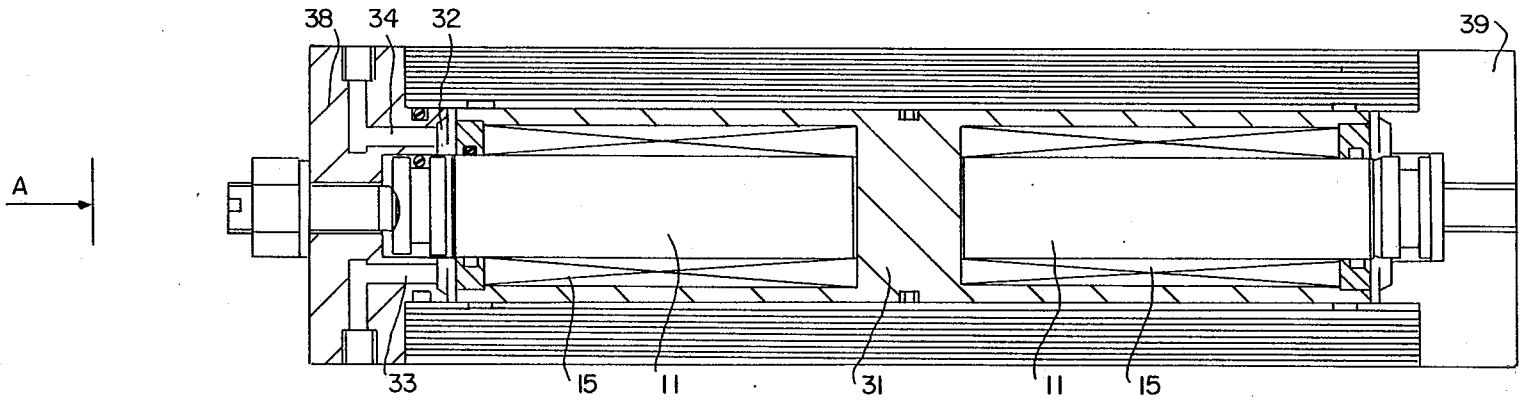
FIGS. 8A and 8B shows an alternative form of a terfenol rod-driven pump.
Figure 8B:
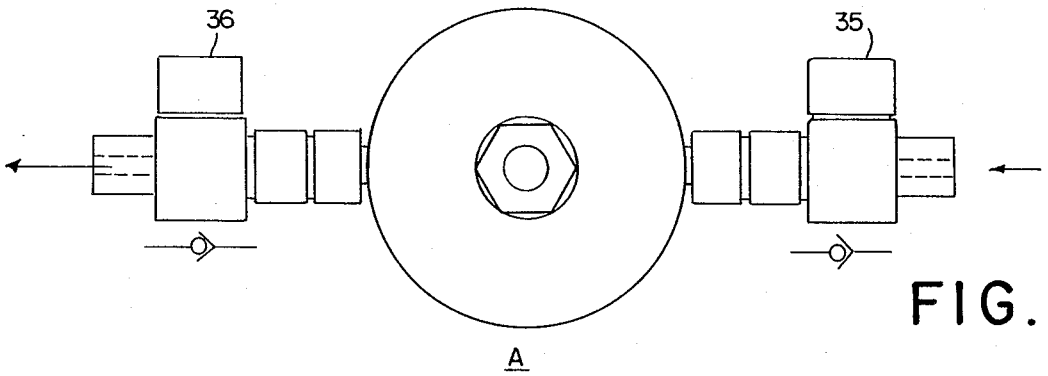

FIGS. 7 and 8 show an alternative construction of a terfenol rod-driven pump. Two alternately operating terfenol rods 11, arranged in pairs, are brought together into a common piston-like part 31, which acts in a cylinder space 32 in a cylindrical casing 37. In the end surfaces 38, 39 of the cylinder space, openings 33, 34 are arranged for the supply and discharge of liquid. When supplying current to the coils alternately, one of the terfenol rods will expand and the other contract, as has been mentioned above, which causes the piston to be moved and bring about a pumping function. To obtain a pumping action, nonreturn valves 35, 36 are connected to the openings 33, 34 on both sides of the pump. Possibly, only one side of the pump can be used, thus obtaining a pulsating flow.

Figure 9:
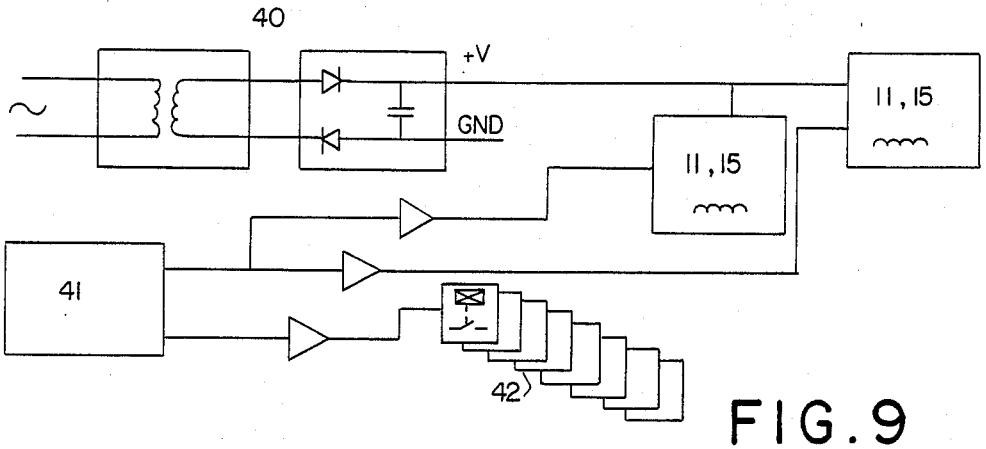
FIG. 9 shows a principle sketch of terfenol electronics (schematic view of the electrical system of the pump)

FIG. 9 shows a schematic view of the electric drive system of the pump. A supply device 40 supplies the pump with electric power, the supply device transforming the supplied electric power into the desirable voltage and current. A processor 41 is used to control the current through the coils 15 which magnetize the terfenol rods 11. If the pump is equipped with current controlled valves, the processor can also be utilized for controlling these valves 42 to keep pace with the movements of the terfenol rods. Transistor bridges are used for driving the coils of the terfenol rods. Transistor switches are used for driving the valves.

In those cases where the current supply is not performed continuously, the supply voltage can be obtained either by transformation and rectification of the alternating voltage, or by DC/DC conversion of a direct voltage. An ampere-turn density of 80 kA/m has been considered sufficient. To obtain an ampere-turn density of 80 kA/m in a 15 cm coil with 1,500 turns, 8 A is needed. The supply voltage must be so high that the coil current can increase from 0 A to 8 A in 2–3 msec.

The magnetostriction of the terfenol rods is proportional to the current through the coil which surrounds it. To obtain it definite movement, the coil current must therefore be controlled. This is done with the aid of a processor with ancillary components. The current curve for a 50 Hz cycle is sampled with, for example, 10 kHz and stored in a permanent storage, PROM. The processor then fetches a new desired value in the storage every 100th microsecond. The desired value is compared with the actual value through the coil. This is obtained via a current transformer, the output voltage of which is measured by means of an A/D convertor. The processor thereafter controls a pulse width modulator (PWM), which in turn controls the transistors in the bridge-connected drivers of the coils.

The power supply to the pump can be accomodated in the same space as the electronics for the control system. The space can be filled with air or nitrogen gas under normal pressure. However, in the pump concept sealing against sea water is less critical than sealling against the high hydraulic pressures in the pump chambers.

Figure 10:
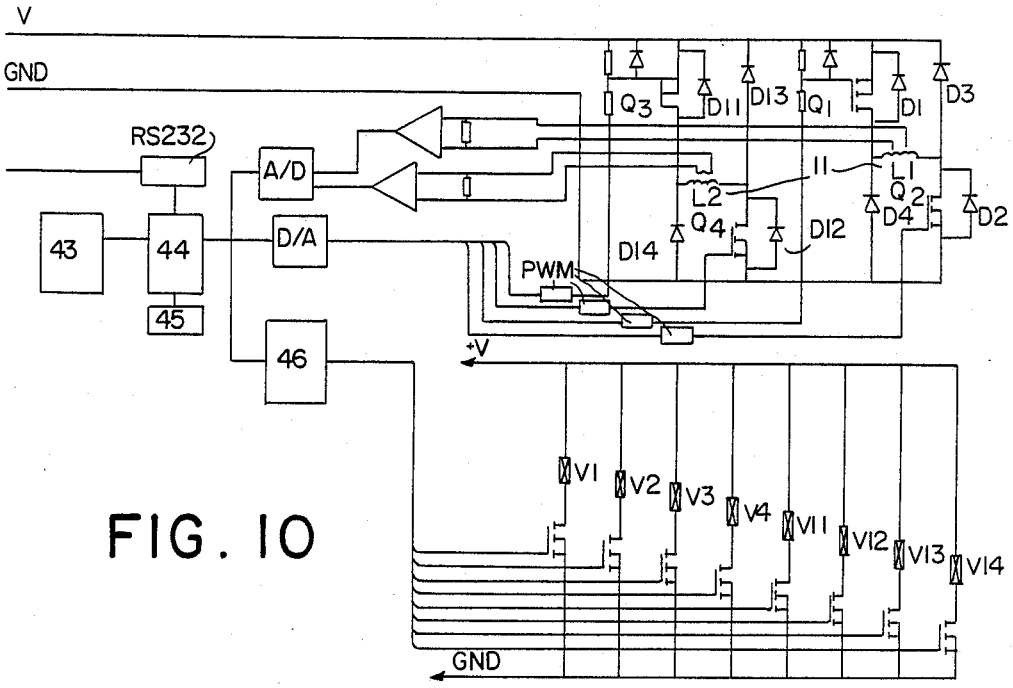
FIG. 10 shows an electronic system for the driving of terfenol rods and valves.

FIG. 10 shows how an electric system is arranged, when the current supply is not performed continuously, for driving the terfenol rods and the valves. A desired current curve is stored in the PROM. The transistors Q1–Q4 are controlled by a processor 44 via the pulse width modulators in such a way that the current curve is followed. An optional current curve can be plotted, the only limitation being the rate of change which is limited upwards because the supply voltage is not infinite. Feedback is obtained with the aid of current transformers. During the first half-cycle the current is to increase in one coil L1 for one of the rods. Q2 is conducting. Q1 is pulse-width modulated, for example with 50 kHz, to the desired rate of change of the current. When Q1 is conducting, the current flows through Q1 and Q2. When Q1 is non-conducting, L1 changes polarity and the current instead flows through Q2 and D4 and is almost constant. Since Q1 is switched off and on at certain intervals (is pulse-width modulated), an optional current increase can be achieved. During the second half-cycle the current is to decrease in one coil L1 and increase in the other coil L2, whereby Q1 is non-conducting and Q2 is pulse-width modulated so that the current is reduced at the desired rate according to the following. When Q2 is conducting, the current flows through Q2 and D4 and is almost constant. When Q2 is throttled, the voltage increases across one coil L1 and the current passes through D3 and D4. The coil now runs in generator mode. For the second coil L2 the bridge functions in the same way as for the first, but 180° out of step. With this mode of operation the current through one of the bridges will increase while at the same time the other bridge will deliver current, and in that way the current requirement from the supply is reduced.

If the processor also controls the valves, data from timer 45 and PROM 43 are used. Control signals are supplied to the FET transistors via a combined latch and driver 46. The FET transistors switch the current through the valve coils off and on. This causes the valves to close and open. Since the valves are to be capable of being opened and closed relatively fast—switching times of 1 msec are necessary—valves with normal AC coils cannot be used. Therefore, DC is used for the valves.

We claim:

1. A pump for liquids driven by magnetostrictive rods, comprising:

a housing including a piston space therein;

a piston mounted for reciprocating movement along an axis extending within said piston space;

at least one pair of magnetostrictive rods including first and second rods made of a magnetostrictive material and mounted to engage with, said piston along said axis; and coils surrounding each of said first and second rods adapted to generate magnetic fields such that motion is imparted to said piston in one direction along said axis with said first rod being deformed and simultaneously therewith said second rod dynamically prestressing said first rod, and such that motion in the opposite direction to said one direction is imparted to said piston with said second piston being deformed and simultaneously therewith said first rod dynamically prestressing said second rod, whereby said piston moves with a reciprocating movement.

2. A pump according to claim 1, wherein said housing includes valve-controlled inlets and valve-controlled outlets for the pumped liquid, said piston space including end surfaces connected to said valve-controlled inlets and outlets.

3. A pump according to claim 1, further comprising a spacing element between said housing and each of said first and second rods.

4. A pump according to claim 1, further comprising means for adjusting the mechanical stress level of said first and second rods.

5. A pump according to claim 4, further comprising a spacing element between said means for adjusting and each of said first and second rods.

* * * * *